US010793796B2

(12) United States Patent
Kiiski et al.

(10) Patent No.: US 10,793,796 B2
(45) Date of Patent: Oct. 6, 2020

(54) RENEWABLE DVPE ADJUSTMENT MATERIAL, FUEL BLEND CONTAINING THE SAME, AND METHOD FOR PRODUCING A FUEL BLEND

(71) Applicant: NESTE OYJ, Espoo (FI)

(72) Inventors: Ulla Kiiski, Hamari (FI); Marina Lindblad, Helsinki (FI); Jukka Myllyoja, Vantaa (FI); Anna Karvo, Porvoo (FI)

(73) Assignee: NESTE OYJ, Espoo (FI)

( * ) Notice: Subject to any disclaimer, the term of this patent is extended or adjusted under 35 U.S.C. 154(b) by 0 days.

(21) Appl. No.: 15/392,476

(22) Filed: Dec. 28, 2016

(65) Prior Publication Data

US 2017/0183586 A1 Jun. 29, 2017

(30) Foreign Application Priority Data

Dec. 29, 2015 (EP) ..... 15202930

(51) Int. Cl.

| | |
|---|---|
| ***C10L 1/02*** | (2006.01) |
| ***C10L 9/10*** | (2006.01) |
| ***C10L 1/10*** | (2006.01) |
| ***C10L 1/16*** | (2006.01) |
| ***C10L 1/182*** | (2006.01) |

(52) U.S. Cl.

CPC ..... *C10L 1/1616* (2013.01); *C10L 1/023* (2013.01); *C10L 1/1824* (2013.01)

(58) Field of Classification Search

CPC combination set(s) only.

See application file for complete search history.

(56) References Cited

U.S. PATENT DOCUMENTS

| | | | | |
|---|---|---|---|---|
| 5,015,356 | A * | 5/1991 | Talbert | C10L 1/023 208/17 |
| 5,608,105 | A | 3/1997 | Fitzpatrick | |
| 5,697,987 | A | 12/1997 | Paul | |
| 6,309,430 | B1 | 10/2001 | Paul | |
| 7,981,170 | B1 | 7/2011 | Lieder et al. | |
| 8,518,130 | B2 * | 8/2013 | Croft | C10L 1/1608 44/388 |
| 2002/0035802 | A1 | 3/2002 | Paul | |
| 2003/0154649 | A1 | 8/2003 | Hull et al. | |
| 2004/0123516 | A1 | 7/2004 | Hull et al. | |
| 2007/0256354 | A1 * | 11/2007 | Gibbs | C10L 1/023 44/451 |
| 2008/0086933 | A1 * | 4/2008 | Cunningham | C10L 10/10 44/451 |

(Continued)

FOREIGN PATENT DOCUMENTS

| | | |
|---|---|---|
| WO | WO 01/53437 A1 | 7/2001 |

OTHER PUBLICATIONS

Search Report dated Jun. 8, 2016 by the European Patent Office for Application No. 15202930.2

(Continued)

*Primary Examiner* — Ellen M McAvoy
*Assistant Examiner* — Ming Cheung Po
(74) *Attorney, Agent, or Firm* — Buchanan Ingersoll & Rooney PC

(57) ABSTRACT

The present invention relates to a light fuel composition comprising fossil fuel, ethanol, and a bio-hydrocarbon composition as a DVPE adjustment material.

21 Claims, 2 Drawing Sheets

(56) References Cited

U.S. PATENT DOCUMENTS

| | | | | |
|---|---|---|---|---|
| 2013/0237728 | A1 | 9/2013 | Lotero et al. | |
| 2017/0044443 | A1 * | 2/2017 | Blommel | C10G 3/42 |

OTHER PUBLICATIONS

First Office Action dated Mar. 31, 2020 by the Chinese Patent Office in corresponding Chinese Patent Application No. 201611245426.9, and an English Translation of the Office Action. (16 pages).

* cited by examiner

RENEWABLE DVPE ADJUSTMENT MATERIAL, FUEL BLEND CONTAINING THE SAME, AND METHOD FOR PRODUCING A FUEL BLEND

TECHNICAL FIELD

The present invention relates to the use of a bio-hydrocarbon composition as a DVPE (dry vapour pressure equivalent) adjustment material. The bio-hydrocarbon is produced from a renewable carbon source. Further, the invention relates to a fuel blend containing the DVPE adjustment material and to a method for producing a fuel blend.

BACKGROUND ART

The DVPE (dry vapour pressure equivalent) is a parameter which indicates the usability of a fuel under various temperature conditions. The higher the DVPE, the higher the volatilization tendency of fuel with the effect that fuel evaporation loss and environmental contamination at elevated temperature increase. Accordingly, the DVPE is a parameter which is particularly relevant for light fuels, such as gasoline. Apparently, summer grade fuel and fuel designated for countries in which high temperatures predominate must have a lower DVPE than winter grade fuel.

Since the volatile components of light fuel are usually available in large amounts, it is a general desire to incorporate the same into the fuel in large amounts, up to a level which just meets the respective requirements of the target market. In other words, conventional (fossil) fuels are produced close to the respective DVPE requirement limits so that there is no much tolerance for DVPE increasing materials.

Ethanol, which is nowadays regularly added to fuel as a renewable material (material based on a renewable carbon source), as a neat material has a very low DVPE of about 16 kPa at 37.8° C. (Owen K., Coley T., Automotive fuels reference book, $2^{nd}$ ed., 1995). However, when mixed with conventional fuel, it has an effect of significantly increasing the DVPE, especially in the mixing range of 0.1 to 30% by volume. That is, even the tiniest amounts of ethanol lead to a significant increase of the DVPE of fossil fuel, whereas the DVPE remains almost constant in a range of about 5 to 10% by volume, and then decreases again with increasing ethanol content (cf. FIG. 1).

The addition of ethanol, which is desirable in view of increasing the renewable content of fuel, thus results in problems regarding the DVPE. The prior art proposes several approaches to resolve this problem.

EP 1 252 268 B1 discloses an oxygen-containing component as a material for adjusting the DVPE of a fuel composition containing up to 20 vol % ethanol. The oxygen-containing component is preferably an alcohol other than ethanol.

U.S. Pat. No. 5,015,356 B discloses removal of heavy and light components from conventional fuel to give fuel containing mainly $C_{6-10}$ alkanes. The DVPE is thus decreased, which allows addition of ethanol.

U.S. Pat. No. 7,981,170 B1 discloses a fuel blend containing at least 2 hydrocarbon streams and 1 oxygenate (e.g. ethanol) stream, wherein the overall alcohol content is >5.0 vol % with the intention avoid the addition of MTBE as an oxygenate component. The blends allow addition of ethanol while still fulfilling regulatory requirements regarding the DVPE.

DISCLOSURE OF THE INVENTION

The approaches of the prior art, however, still face some problems.

The approach selected by EP 1 252 268 B1 increases the total content of oxygenates and requires the addition of specific compounds which tends to increase costs.

The approaches of U.S. Pat. No. 5,015,356 B and U.S. Pat. No. 7,981,170 B1 are based on the fact that some hydrocarbon streams from fuel refining or sub-distillates thereof have a low DVPE. Thus, by appropriately combining these (sub)-streams, it is possible to provide a fuel base composition which tolerates the addition of ethanol. However, using this approach, the content of renewable material in the fuel remains the same and, in addition, the (sub)-streams which are not usable in these approaches remain as a low-value material of fossil origin. Thus, these approaches effectively reduce the content of fossil fuel in gasoline, while resulting in larger amounts of low-value (and thus cheap) fossil by-products which are then used for other applications instead of more expensive renewable material.

It is thus an object of the present invention to increase the content of renewable material in fuel while still meeting the regulatory requirements for DVPE. In addition, the present invention aims at meeting these requirements when using conventional fossil fuel (containing no oxygen) as a base material, so as to facilitate the parallel production of fossil-only fuel and bio-ethanol modified fuel in the same plant while achieving similar properties (at least similar DVPE) for both fuels.

The present invention solves these problems by providing a renewable DVPE adjustment material which is available from renewable sources in large quantities and allows fine-tuning of DVPE in fuels containing ethanol in a broad content range.

The present invention relates to a fuel as defined in claim 1 and to a method as defined in claim 14. Further beneficial developments are set forth in dependent claims.

Particularly, the present invention relates to one or more of the following items:

1. A light fuel composition comprising fossil fuel, ethanol, and a DVPE adjustment material, wherein the DVPE adjustment material is a bio-hydrocarbon composition.
2. The light fuel according to item 1, wherein the DVPE adjustment material is contained in such an amount that the following formula (1) is fulfilled:

$$Dg \leq Df + (1-x)*(Dfe-Df) \quad (1)$$

wherein Dg is the DVPE of the light fuel, Dfe is the DVPE of a mixture (fe) of the fossil fuel and the ethanol, the mixture (fe) having an ethanol content (by volume) which is the same as that of the light fuel, and Df is the DVPE of the fossil fuel, wherein the DVPE is measured in accordance with EN 13016-1, and x is 0.30 or more, preferably 0.35 or more, 0.40 or more, 0.50 or more, 0.60 or more, 0.70 or more, 0.80 or more, 0.90 or more, or 1.0 or more.

3. The light fuel according to item 1 or 2, wherein the DVPE of the light fuel, as measured in accordance with EN 13016-1, is less than 90 kPa, preferably less than 80.0 kPa, less than 75.0 kPa, less than 70.0 kPa, less than 69.0 kPa, less than 68.0 kPa, less than 67.0 kPa, less than 65.0 kPa, or less than 63.0 kPa.
4. The light fuel according to any one of items 1 to 3, wherein the content of the DVPE adjustment material is 0.1% by volume or more, preferably 1.0% by volume or more, 3.0% by volume or more, 5.0% by volume or more, 7.0% by volume or more, 9.0% by volume or more, 15.0% by volume or more, or 20.0% by volume or more.

5. The light fuel according to any one of items 1 to 4, wherein the content of the ethanol in the light fuel is 0.1 by volume or more, preferably 0.5% by volume or more, 1.0% by volume or more, 1.2% by volume or more, 1.6% by volume or more, 2.0% by volume or more, 3.0% by volume or more, or 5.0% by volume or more, and/or wherein the content of the ethanol in the light fuel is 40.0% by volume or less, preferably 35.0% by volume or less, 30.0% by volume or less, 25.0% by volume or less, 20.0% by volume or less, 15.0% by volume or less, or 11.0% by volume or less.
6. The light fuel according to any one of items 1 to 4, wherein the content of the ethanol in the light fuel is 0.1 by volume or more, preferably 0.5% by volume or more, 1.0% by volume or more, 1.2% by volume or more, or 1.6% by volume or more, and/or wherein the content of the ethanol in the light fuel is 7.0% by volume or less, preferably 6.0% by volume or less, 5.5% by volume or less, 5.0% by volume or less, 4.0% by volume or less, 3.5% by volume or less, or 3.0% by volume or less.
7. The light fuel according to any one of items 1 to 6, wherein the bio-hydrocarbon composition has a content of naphthenes of 30% by weight or more, preferably 35% by weight or more, 40% by weight or more, 45% by weight or more, 50% by weight or more, or 52% by weight or more, and/or wherein the bio-hydrocarbon composition has a content of naphthenes of 90% by weight or less, 80% by weight or less, 70% by weight or less, or 66% by weight or less.
8. The light fuel according to any one of items 1 to 7, wherein the bio-hydrocarbon composition has a content of paraffins of 15% by weight or more, preferably 20% by weight or more, 25% by weight or more, 30% by weight or more, or 32% by weight or more, and/or wherein the bio-hydrocarbon composition has a content of paraffins of 70% by weight or less, preferably 60% by weight or less, 55% by weight or less, 50% by weight or less, or 46% by weight or less.
9. The light fuel according to any one of items 1 to 8, wherein the bio-hydrocarbon composition has a content of aromatics of 35.0% by weight or less, preferably 30.0% by weight or less, 25.0% by weight or less, 20.0% by weight or less, 15.0% by weight or less, 10.0% by weight or less, 7.0% by weight or less, 6.0% by weight or less, 5.0% by weight or less 4.0% by weight or less, 3.0% by weight or less, 2.5% by weight or less, 2.0% by weight or less, or 1.6% by weight or less.
10. The light fuel according to any one of items 1 to 8, wherein the bio-hydrocarbon composition is obtainable by subjecting an oxygen-containing bio-precursor composition to a hydrodeoxygenation (HDO) treatment.
11. The light fuel according to item 10, wherein the bio-precursor composition is obtainable by subjecting a raw material obtained from a renewable source to at least one C—C-coupling reaction.
12. The light fuel according to any one of items 1 to 11, wherein the bio-hydrocarbon composition is derived from a raw material containing a ketoacid or a derivative thereof derived from a renewable source. The ketoacid or the derivative thereof is preferably levulinic acid or a derivative thereof.
13. The light fuel according to any one of items 1 to 12, wherein the fossil fuel is a fossil hydrocarbon fraction, in which 90% by weight of all hydrocarbons have a carbon number in the range of 3 to 13.
14. A method for producing a light fuel, the method comprising blending a fossil fuel, ethanol and a DVPE adjustment material, wherein the DVPE adjustment material is a bio-hydrocarbon composition.

DETAILED DESCRIPTION OF THE INVENTION

Figure 1:
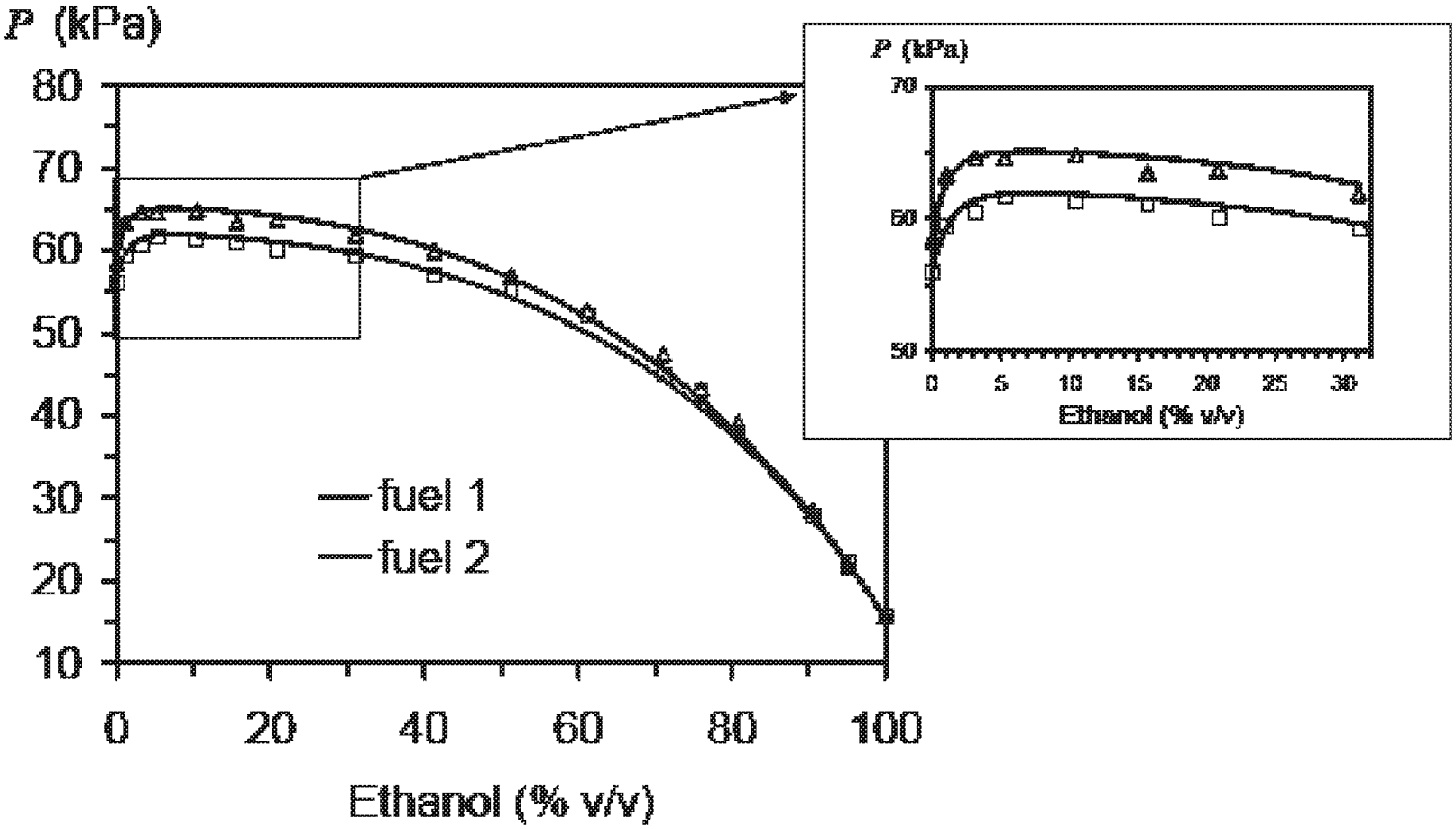
FIG. 1 is a diagram showing the change of DVPE of conventional fossil fuel with addition of ethanol

The present invention relates to a light fuel composition (preferably a gasoline composition) comprising fossil fuel, ethanol, and a DVPE adjustment material, wherein the DVPE adjustment material is a bio-hydrocarbon composition.

In the present invention, the term bio-hydrocarbon composition means a hydrocarbon composition derived from a renewable source. Particularly, it means that the carbon atoms of the hydrocarbon composition are derived from a renewable carbon source. Such a renewable carbon source includes all kinds of (bio-based) oils and fats (e.g. vegetable oils/fats, animal oils/fats), wood-based material (e.g. cellulose, lignocellulose), sugars, and so on.

The term light fuel (composition) relates to a fuel (composition) having a final boiling point (according to EN ISO 3405) of at most 210° C.

Many renewable materials which are available in a large quantity (mainly oils, fats and wood-based materials) have a quite well-defined composition. Thus, by appropriately treating the renewable material, it is possible to produce a hydrocarbon composition having a well-defined product composition, in particular a narrow carbon number distribution. The inventors of the present invention now surprisingly found that renewable materials are a suitable raw material for hydrocarbon compositions having well defined properties and being suited for fine-tuning DVPE of ethanol-containing fuels, which was difficult heretofore.

The ethanol in the present invention is preferably bio-ethanol.

Preferably, the DVPE adjustment material is contained in the light fuel of the present invention in such an amount that the following formula (1) is fulfilled:

$$Dg \leq Df + (1-x)*(Dfe-Df) \quad (1)$$

In formula (1), Dg is the DVPE of the light fuel of the present invention, Dfe is the DVPE of a mixture (fe) of the fossil fuel and the ethanol, the mixture (fe) having an ethanol content (% by volume) which is the same as that of the light fuel of the present invention, and Df is the DVPE of the fossil fuel alone, and x is 0.30 or more, preferably 0.35 or more, 0.40 or more, 0.50 or more, 0.60 or more, 0.70 or more, 0.80 or more, 0.90 or more, or 1.0 or more.

In the present invention, the DVPE is measured in accordance with EN 13016-1.

In the above formula (1), x is a compensation factor and indicates the compensation degree achieved by addition of the DVPE adjustment material relative to the DVPE increase caused by the addition of ethanol to the (raw) fossil fuel. Specifically, the value Dg indicates the DVPE of the light fuel of the present invention, which contains ethanol in a specific amount (y % by volume), fossil fuel, and the DVPE adjustment material. Dfe indicates the absolute value of DVPE of a composition containing the above fossil fuel and having the same ethanol content (y % by volume). (Dfe−Df) then indicates the absolute increase of DVPE which is caused by including y vol % of ethanol in the above fossil fuel.

Accordingly, a value of x=0.5 means that 50% of the (absolute) increase of DVPE caused by the addition of ethanol to the fossil fuel is compensated by exchanging a part of the fossil fuel for the DVPE adjustment material (so that the relative ethanol content remains the same). A value of x=1.0 means full compensation, i.e. the DVPE of the light fuel of the present invention is the same as that of the fossil fuel alone. A value of larger than 1.0 then means that the DVPE of the light fuel is even lower than that of the fossil fuel alone.

In terms of absolute values, it is preferable that the DVPE of the light fuel, as measured in accordance with EN 13016-1, is less than 90 kPa, preferably less than 80.0 kPa, less than 75.0 kPa, less than 70.0 kPa, less than 69.0 kPa, less than 68.0 kPa, less than 67.0 kPa, less than 65.0 kPa, or less than 63.0 kPa.

In order to achieve the effects of the invention, the content of the DVPE adjustment material may be 0.1% by volume or more, preferably 1.0% by volume or more, 3.0% by volume or more, 5.0% by volume or more, 7.0% by volume or more, 9.0% by volume or more, 15.0% by volume or more or 20.0% by volume or more. Suitably, the content of the DVPE adjustment material can be 80% by volume or less, 60% by volume or less, 40% by volume or less, 30% by volume or less, or 25% by volume or less.

Although defining absolute content ranges is not as meaningful as defining the DVPE decrease relative to the increase caused by ethanol addition, the aforementioned ranges represent usual addition ranges of the present invention for fuels containing 1-10% by volume ethanol. However, one should bear in mind that the DVPE decreasing effect of the DVPE adjustment material of the present invention depends not only on the ethanol content but also on the type of the base fuel (fossil fuel) used.

In an embodiment of the present invention, it is preferable that the content of the ethanol in the light fuel be 0.1 by volume or more, preferably 0.5% by volume or more, 1.0% by volume or more, 1.2% by volume or more, 1.6% by volume or more, 2.0% by volume or more, 3.0% by volume or more, or 5.0% by volume or more. The content of the ethanol in the light fuel may further be 40.0% by volume or less, preferably 35.0% by volume or less, 30.0% by volume or less, 25.0% by volume or less, 20.0% by volume or less, 15.0% by volume or less, or 11.0% by volume or less.

In other words, the DVPE adjustment material of the present invention is suited for a broad range of ethanol contents.

In an embodiment of the present invention, the content of the ethanol in the light fuel may be 0.1 by volume or more, preferably 0.5% by volume or more, 1.0% by volume or more, 1.2% by volume or more, or 1.6% by volume or more, and particularly 7.0% by volume or less, preferably 6.0% by volume or less, 5.5% by volume or less, 5.0% by volume or less, 4.0% by volume or less, 3.5% by volume or less, or 3.0% by volume or less.

That is, the DVPE adjustment material of the present invention is particularly suitable for fuel having a low content of ethanol, where a fine-tuning of the DVPE value was heretofore very difficult. That is, since the DVPE of a fuel containing low amounts (in particular 0.1-7.0% by volume, more specifically 0.1 to 3.0% by volume) tends to change strongly even if only minor changes of the ethanol content occur, the fine-tuning properties of the DVPE adjustment material of the present invention can be of particular value.

The bio-hydrocarbon composition constituting the DVPE adjustment material preferably has a content of naphthenes of 30% by weight or more, preferably 35% by weight or more, 40% by weight or more, 45% by weight or more, 50% by weight or more, or 52% by weight or more. Although not particularly limited, the DVPE adjustment material may have a content of naphthenes of 90% by weight or less, 80% by weight or less, 70% by weight or less, or 66% by weight or less.

The inventors of the present invention surprisingly found that high an amount of naphthenes (cyclic hydrocarbons) is beneficial for achieving the DVPE adjustment property of the present invention. Furthermore, hydrocarbons having high a content of naphthenes are available from renewable materials via a large variety of production routes.

The bio-hydrocarbon composition may have a content of paraffins (non-cyclic alkanes) of 15% by weight or more, preferably 20% by weight or more, 25% by weight or more, 30% by weight or more, or 32% by weight or more. Further, the bio-hydrocarbon composition may have a content of paraffins of 70% by weight or less, preferably 60% by weight or less, 55% by weight or less, 50% by weight or less, or 46% by weight or less. Although the content of paraffins is not particularly limited, it is preferred that the paraffins constitute the main hydrocarbon group, apart from the naphthenes.

It is particularly preferable that the sum of naphthenes and paraffins in the bio-hydrocarbon composition amount for 85% by weight of more, preferably 90% by weight or more, or 95% by weight or more of the bio-hydrocarbon composition in total.

The content of aromatics and/or olefins in the bio-hydrocarbon composition is not particularly limited but it is preferred that at least the content of olefins be rather low. Preferably, the bio-hydrocarbon composition has a content of aromatics of 35.0% by weight or less, preferably 30.0% by weight or less, 25.0% by weight or less, 20.0% by weight or less, 15.0% by weight or less, 10.0% by weight or less, 7.0% by weight or less, 6.0% by weight or less, 5.0% by weight or less, 4.0% by weight or less, 3.0% by weight or less, 2.5% by weight or less, 2.0% by weight or less, or 1.6% by weight or less. The content of olefins is preferably 12.0% by weight or less, preferably 8.0% by weight or less, 5.0% by weight or less, 4.0% by weight or less, 3.5% by weight or less, or 3.0% by weight or less. Although the content of aromatics and olefins does not have a deciding influence on the DVPE adjustment property of the bio-hydrocarbon composition, a low content of aromatics and olefins allows broader addition ranges of the bio-hydrocarbon composition to fossil fuel, since regulatory requirements often set an upper limit for these components. On the other hand, a high aromatics content is suited to increase octane number level. Accordingly, high contents of aromatics may be favourable in some cases.

The content of aromatics can be influenced, among others, by the temperature in the HDO treatment.

Furthermore, it is preferred that the bio-hydrocarbon composition in the present invention contains mainly hydrocarbons having a carbon number in the range of 5 to 12, preferably 6 or more, more preferably 7 or more, even more preferably 8 or more, and preferably 11 or less, more preferably 10 or less. With containing mainly hydrocarbons in the aforementioned ranges, it is meant that hydrocarbons having a carbon number in the stated range account for at least 75% by weight, preferably at least 80% by weight, more preferably at least 90% by weight, even more preferably at least 95% by weight, or at least 97% by weight of the whole hydrocarbon composition.

Hydrocarbons having carbon numbers in the above-identified ranges have been found to have a strong DVPE adjustment effect. Furthermore, hydrocarbon compositions having well defined (and narrow) carbon number distributions are readily available from renewable material depending on the actual production method without the need of complicated fractionated distillation and blending operations.

In the present invention, the content of paraffins, naphthenes, aromatics and/or olefins as well as the carbon number distribution thereof may be determined using any suitable method. For example, the relative contents of hydrocarbons may be detected with GC-FID (gas chromatography—flame ionization detector). The relative weight response factors in GC-FID analysis for all hydrocarbons (except benzene and toluene) can be assumed to be 1. The contents of benzene, toluene and other aromatics as well as the content of oxygenates, if present, may be determined using standard methods (e.g. EN12177, EN 13132).

As one method for obtaining the bio-hydrocarbon composition of the present invention, it is preferable that the composition be obtained by subjecting an oxygen-containing bio-precursor composition to a hydrodeoxygenation (HDO) treatment.

Most renewable carbon sources contain a significant amount of oxygen. Thus, before using a precursor composition (obtained by optionally pre-treating a renewable raw material) as a bio-hydrocarbon composition of the present invention, it is necessary to remove the oxygen. The most convenient way to do this is a HDO (hydrodeoxygenation) reaction using hydrogen and a HDO catalyst, or a dehydroxylation or decarboxylation reaction using hydrogen.

The bio-precursor composition may be obtainable by subjecting a raw material obtained from a renewable source to at least one C—C-coupling reaction. In many cases, renewable raw materials have a carbon number which is not well suited for the purposes of the present invention. In this respect, the "carbon number" of the raw material here relates to the number of carbons in the molecule connected with C—C-bonds, since this reflects the carbon number of the hydrocarbon after a HDO reaction.

Specifically, raw materials derived from wood, which is available in large amounts, such as cellulose or lignocellulose, often result in raw materials (pre-processed material) having a carbon number of 4 to 6.

Accordingly, a C—C-coupling reaction may be carried out in order to bring the carbon number into ranges which are more suited for the purpose of the present invention (in particular 8 to 10). Specific methods will be described later.

The bio-hydrocarbon composition may be derived from a raw material containing a ketoacid or a derivative thereof which is derived from a renewable source. The ketoacid or the derivative thereof may be a (β-ketoacid, a γ-ketoacid or a δ-ketoacid, or a derivative thereof. The ketoacid may have a carbon number (largest number of carbons in the molecule connected with carbon-carbon direct bonds) of 3 or more, preferably 4 or more, more preferably 5 or more, and/or of 10 or less, preferably 9 or less, 7 or less or 6 or less. Particularly, the ketoacid or the derivative thereof is levulinic acid (carbon number: 5) or a derivative thereof.

Levulinic acid is available in large amounts from lignocellulosic material, which makes it a good candidate for a raw material for the bio-hydrocarbon composition of the present invention. Furthermore, the presence of a keto group and an acid group (or aldehyde group) in a ketoacid allows a large variety of C—C-coupling reactions which yield well-defined carbon chain lengths. When employing β-, γ- or δ-ketoacids, the probability of formation of ring structures during C—C-coupling reactions is high, which tends to increase the content of naphthenes in the hydrocarbon composition. Additionally the high reactivity of these compounds tends to produce cyclic compounds at high temperatures i.e. high temperature HDO of these molecules. Although the above-mentioned materials are particularly preferable in the present invention, the hydrocarbon composition may be produced from any suited renewable source.

In the light fuel of the present invention, the fossil fuel is preferably a fossil hydrocarbon fraction in which 90% by weight of all hydrocarbons have a carbon number in the range of 3 to 13. It is particularly preferable that the fossil fuel be a hydrocarbon fraction boiling in the range up to 210° C. The DVPE of the fossil fuel may be in the range of 50 to 90 kPa and is preferably 55 or more, 60 or more, or 63 or more, further preferably 75 kPa or less, 70 kPa or less or 67 kPa or less.

In another embodiment, the present invention provides a method for producing a light fuel. The method comprises blending a fossil fuel, ethanol and a DVPE adjustment material, wherein the DVPE adjustment material is a bio-hydrocarbon composition.

Preferably, the method produces the light fuel of the present invention. Accordingly, it is preferred that the DVPE adjustment material has the same properties and/or be produced in the same manner as the DVPE adjustment material contained in the light fuel of the present invention.

According to a further embodiment, the present invention provides a use of a bio-hydrocarbon composition as a DVPE adjustment material. It is preferable that the DVPE adjustment material has the same properties and/or be produced in the same manner as the DVPE adjustment material contained in the light fuel of the present invention. It is further preferred that the use results in the light fuel of the present invention.

Details of the aspects of the present invention as recited above will be presented in the following. In the following, the term "ketoacid" is used for both ketoacid and ketoacid derivative.

First, some methods for producing a bio-hydrocarbon composition will be described using ketoacids derived from a renewable source as an example.

An example of a method for producing the bio-hydrocarbon composition in the present invention comprising the steps of subjecting a feedstock comprising at least one ketoacid to a C—C coupling reaction so as to produce a ketoacid dimer, and then subjecting the ketoacid dimer to at least one hydrodeoxygenation (HDO) step. Using this method, a hydrocarbon composition having a very narrow carbon number distribution can be produced.

Alternatively, the above-mentioned ketoacid dimer may be subjected to a further C—C-coupling reaction with a ketoacid (monomer). This reaction can produce mainly ketoacid trimers.

The C—C-coupling reaction for producing ketoacid dimers may be carried out using an acidic ion exchange resin as a catalyst, optionally in the presence of hydrogen. The ion exchange resin may carry a hydrogenating metal. A separation step may follow the C—C-coupling step for removal of educts (e.g. ketoacid monomers) and by-products. At least the ketoacid dimers (derivatives) may be subjected to a hydrodeoxygenation (HDO) reaction to obtain a HDO product. The HDO product may be used as the bio-hydrocarbon composition as it is or may be subjected to separation (e.g. distillation) to remove by-products and educts.

In the present invention, the ketoacid employed may be any kind of ketoacid having one keto group and one acid group. The ketoacid may be employed in acid form or as a derivative. That is, any modification of the —OH group of the acid group (resulting in esters, amides, anhydrides, for example) or of the ═O group of the keto group of the acid group (resulting in half-acetals, acetals or lactones for example) may be employed. Preferred derivatives are those selected from the group of esters of the ketoacid and/or lactones of the ketoacid.

In the dimerization reaction, the ketoacid (or ketoacid derivative) undergoes a C—C-coupling reaction with another ketoacid (or ketoacid derivative) present in the feedstock so as to produce a ketoacid dimer. The ketoacids participating in the C—C-coupling reaction may be of the same type having the same chemical formula or of a different type. In other words, the dimers may be homodimers or heterodimers, but are preferably homodimers.

Depending on the actual reaction conditions, the ketoacid may undergo different C—C-coupling reactions. In particular the C—C-coupling reactions may be ketonisation reactions or reactions proceeding through an enol or enolate intermediate. Accordingly, the C—C-coupling reactions may be aldol-type reactions and condensations, ketonisations, reactions where the C—C-coupling involves an alkene, as well as other dimerization reactions.

Further, decarboxylation and/or hydrogenation may occur during or after the C—C-coupling reaction, thus providing a dimer derivative having less oxygen and/or carbon atoms then expected from the C—C-coupling reaction only. The decarboxylation reaction does not require hydrogen and removes oxygen by in the form of $CO_2$. If the one carboxylic group of a LA-dimer is removed by as $CO_2$, LA-dimer can produce a C9 hydrocarbon while using less hydrogen (which is usually produced from a fossil source). In this case, the GHG (green house gas) reduction potential compared to fossil fuel is about 65%, which is higher than required by current EU regulations for new bio-fuel. Additionally, if both carboxylic groups of an intermediate LA-dimer are removed by decarboxylation (as $CO_2$), a C8-paraffin is formed and the calculated GHG reduction potential improves to over 70%. Therefore, the deoxygenation reaction route is important for improving the calculated GHG reduction potentials. By controlling the deoxygenation reaction route, it is possible to control the GHG reduction potential, which is very important for bio based fuel.

In view of the above-mentioned reaction routes, the ketoacid dimer (derivative) further includes all compounds directly obtainable from the ketoacid dimer by other reactions such as lactonisation, dehydroxylation or decarboxylation. Examples of ketoacid dimers according to the invention are shown by the following formulas, using levulinic acid aldo reaction dimers as examples:

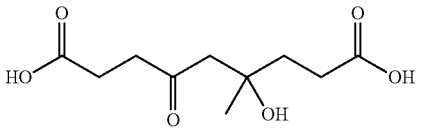

-continued

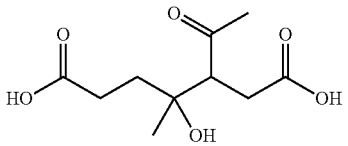

Since these dimers are not very stable under the reaction conditions of the C—C-coupling reaction, these dimers undergo further reactions such as lactonisation, dehydroxylation and partial hydrogenation. Examples of ketoacid dimer derivatives according to the invention are shown by the following formulas, using levulinic acid dimers as examples:

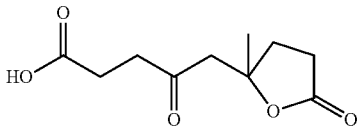

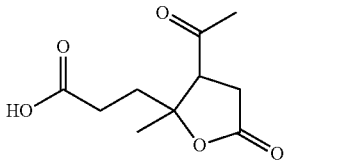

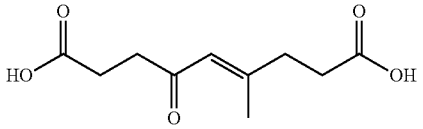

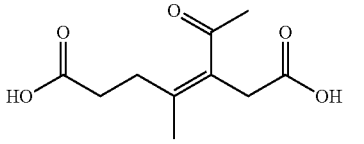

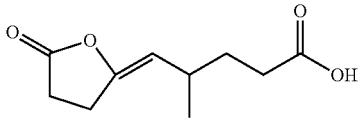

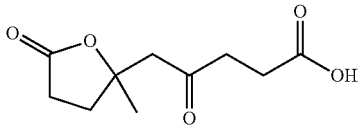

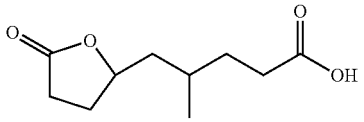

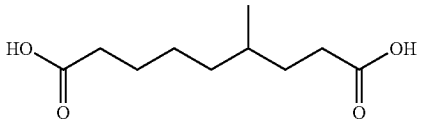

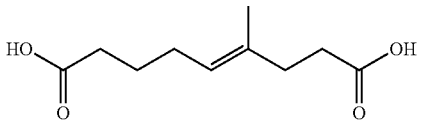

-continued

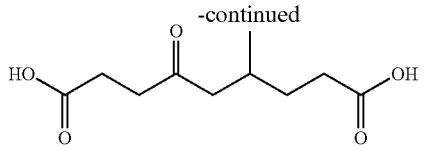

Without wanting to be bound to theory, it is considered that an IER catalyst catalyses mainly aldol condensation reactions of ketoacids. When the C—C-coupling reaction is carried out using β-, γ-, δ- or ε-ketoacids, the resulting dimers easily undergo lactonisation in the further procedure.

When employing a C5 ketoacid (such as levulinic acid), the products obtained by this method are particularly suited as gasoline and/or diesel fuel (preferably after fractionation). Specifically, in this case, the method mainly provides hydrocarbons having 8 to 10 carbon atoms, wherein the majority of the product has 9 or 10 carbon atoms.

As an alternative C—C-coupling reaction with a ketoacid raw material, it is possible to use a solid acid catalyst system comprising two (different) metal oxides, namely a first metal oxide and a second metal oxide. Preferably, the catalyst system has a specific surface area of from 10 to 500 $m^2/g$, and/or the total amount of the acid sites of the catalyst system ranges between 30 and 500 μmol/g.

The first metal oxide may comprise an oxide of one of W, Be, B, Mg, Si, Ca, Sc, Ti, V, Cr, Mn, Fe, Co, Ni, Cu, Zn, Ga, Sr, Y, Zr, Nb, Mo, Cd, Sn, Sb, Bi, La, Ce, Th, K and the second metal oxide may comprise an oxide of one of Zr, Ti, Si, Al, V, Cr or a combination of these. The first metal oxide may be supported on a metal oxide carrier, wherein the carrier is preferably selected from the group consisting of zirconium oxide, titanium oxide, silicon oxide, vanadium oxide or chromium oxide, preferably zirconium oxide or titanium oxide. Specifically, the catalyst system may comprise tungsten oxide or cerium oxide supported on a metal oxide carrier, wherein the carrier is preferably selected from the group consisting of zirconium oxide, titanium oxide, silicon oxide, vanadium oxide or chromium oxide, preferably zirconium oxide or titanium oxide.

The C—C-coupling reaction(s) using the solid acid catalyst system may be conducted at a temperature of 200-400° C., preferably 210-300° C., more preferably 220-280° C. and most preferably 220-260° C., and/or under a pressure of 0.5-100 bar, preferably 1.0-50 bar, more preferably 1.0-20 bar (absolute).

The solid acid (oxide) catalyst system may further comprise at least one hydrogenation metal, preferably selected from Group VIII of the Periodic Table of Elements, preferably from Co, Ni, Ru, Rh, Pd, and Pt.

Using the solid acid catalyst system comprising the first metal oxide and the second metal oxide, it is possible to produce ketoacid oligomers, wherein a majority of the oligomers are present in the form of dimers and the majority of the reminder is present in the form of trimers. Thus, although the reaction product has a slightly broader carbon number distribution, this approach is preferable in view of procedural efficiency, since the reaction can proceed to almost 100% conversion. Accordingly, removal of unreacted educts is not necessary or at least much easier.

As a further alternative, the C—C reaction may be carried out using a base as a catalyst, i.e. subjecting the ketoacid to one or more base catalysed condensation reaction(s).

The base catalysed C—C-coupling reactions may be conducted at a temperature of at least 65° C., preferably at a temperature in the range of 70 to 195° C., more preferably at a temperature in the range of 80 to 160° C., even more preferably at a temperature in the range of 90 to 140° C. and most preferably at a temperature in the range of 100 to 120° C. The base may be a hydroxide, carbonate, or phosphate of an alkaline metal or alkaline earth metal, preferably a hydroxide, carbonate, or phosphate of one of Na, Li, Be, Mg, K, Ca, Sr or Ba, or a combination of these, more preferably sodium hydroxide, potassium hydroxide or lithium hydroxide or a combination of these.

Preferably, the content of the base in the feedstock (i.e. the liquid material to be subjected to the C—C-coupling reaction) is adjusted such that that the pH of the feedstock is at least 8.0, preferably at least 10.0, more preferably at least 12.0. A mixture of at least two basic compounds may be used as the base.

The hydrodeoxygenation (HDO) reaction following any C—C-coupling reaction is preferably carried out at a temperature of 200° C. or more, more preferably 240° C. or more, 260° C. or more, 280° C. or more, 290° C. or more, 300° C. or more, 305° C. or more, or 310° C. or more.

A temperature of 280° C. or more in the HDO step leads to further (thermal) C—C-coupling reactions (further oligomerization reactions) in the HDO step.

The present inventors now surprisingly found that by preliminarily hydrogenation of the ketoacid oligomers/dimers (either as a preliminary step or in the course of the C—C-coupling reaction), the further oligomerization can be suppressed to a certain degree. Thus, the product composition can be controlled using this measure.

The ketoacid employed in the C—C-coupling reaction may contain at least one, preferably at least two, more preferably at least three hydrogen atoms in a-position of the keto group. One hydrogen atom in this position allows aldol-type reactions. In case at least two hydrogen atoms are present in α position of the keto group, further aldol-type reactions may occur. The hydrogen atoms may be present at the same aα carbon or at different α carbons. However, it is preferred that one or both of the carbon atoms in α position of the keto group be in the form of a $CH_2$ group. Further preferably, a $CH_3$ group is present in α position of the keto group.

Levulinic acid is a γ-ketoacid having 5 carbon atoms and has a $CH_2$ group and a $CH_3$ group in α position of the keto group. Thus, as described above, the effects of the present invention are particularly pronounced for levulinic acid and the resulting products are furthermore highly suited as gasoline diesel and aviation fuel components. Moreover, levulinic acid is available from renewable sources (from lignocellulosic material) in large quantities and at reasonable costs, so that it is an interesting platform molecule for the production of renewable petrochemical products.

The C—C-coupling reaction product may be fractionated to remove potential unreacted ketoacids (monomers) and other light components such as water and $CO_2$ formed in the C—C-coupling reaction. The unreacted ketoacid may be recycled to the C—C-coupling reaction.

Unless explicitly stated, the pressure values in the present invention relate to absolute pressures. Further, when speaking of hydrogen pressure or pressure of a specific gas in general, the partial pressure of hydrogen (or the specified gas) is meant.

In the method for producing the bio-hydrocarbon composition, the hydrogenating metal employed in the hydrogenation/HDO step and/or the hydrogenating metal optionally carried by the C—C-coupling catalyst may be selected from metals of the Group VIII of the Periodic Table of Elements, preferably Co, Ni, Ru, Rh, Pd, and Pt, more preferably Pd, or a combination of two or more of these. These metals, in particular Pd, has been found to provide good hydrogenation properties and in particular being well compatible with the requirements of C—C-coupling reactions using an IER.

Preferably, a C—C-coupling reaction using an IER catalyst is conducted at a temperature in the range of 100-200° C., preferably 120-180° C., more preferably 120-160° C., most preferably 120-140° C. This temperature range was found to be particularly suitable for obtaining a high yield of ketoacid dimers (or dimer derivatives) which are suitable to be used in the next step of the method.

The C—C-coupling reaction can be controlled by adjusting several parameters, including by selection of reaction conditions such as weight hourly space velocity (WHSV) (kg feedstock/kg catalyst per hour). Herein, the feedstock includes all liquid material fed to the reactor, excluding the catalyst (system).

The ketoacid may be obtained from processing of lignocellulosic material, and such processed material may be used directly, or purified to varying degrees before being used as a feedstock in the method of the present invention. For example, levulinic acid may be produced with the Biofine method disclosed in U.S. Pat. No. 5,608,105.

Preferably, in the hydrodeoxygenation step, a HDO catalyst is employed which comprises a metal having hydrogenation catalyst function on a support, such as for example a HDO catalyst metal selected from a group consisting of Pd, Pt, Ni, Co, Mo, Ru, Rh, W or any combination of these. The metal having hydrogenation catalyst function may be carried on a support, preferably an inorganic oxide support, more preferably silica, alumina, titania, zirconia, carbon or a combination thereof. A highly preferable HDO catalyst comprises sulfided NiMo, which is preferably supported on an inorganic oxide such as alumina.

Water and light gases may be separated from the HDO product with any conventional means such as distillation. After the removal of water and light gases, the HDO product may be fractionated to one or more fractions.

The method may be carried out in a reactor, such as a stirred tank reactor, preferably a continuous stirred tank reactor, or a tubular flow reactor, preferably a continuous flow reactor. Further, the individual steps of the method may be carried out in the same reactor or in different reactors. Preferably, the C—C-coupling step and the HDO step are carried out in different reactors. The C—C-coupling step and an optional preliminary hydrogenation step may be carried out in the same or in different reactors, wherein, in the latter case, the preliminary hydrogenation step may be carried out in the same reactor as the HDO step (one after another).

The product of the HDO step may also be subjected to an isomerization step in the presence an isomerization catalyst and optionally hydrogen. Both the hydrodeoxygenation step and isomerization step may be conducted in the same reactor. The isomerization catalyst may be a noble metal bifunctional catalyst, for example Pt-SAPO or Pt-ZSM-catalyst. The isomerization step may for example be conducted at a temperature of 200-400° C. and at a pressure of 20-150 bar. Fractionation may be carried out before or after isomerization, but is preferably carried out after isomerization.

EXAMPLES

Example 1

A feedstock containing 98 wt.-parts commercial grade levulinic acid (97 wt-% purity) and 2 wt.-parts water was provided. The feedstock and hydrogen were fed to a tubular reactor supporting Amberlyst CH-34 catalyst (trade name; Pd doped ion exchange resin). The temperature in the reactor was adjusted to 130° C., the hydrogen pressure was 20 bar, WHSV was 0.2 $h^{-1}$ and hydrogen to feedstock (liquid raw material) flow ratio was 1170 Nl/l.

The conversion product obtained after the tubular reactor contained 44 wt.-% non-reacted levulinic acid (LA) and γ-valerolactone (GVL), 53 wt.-% dimers and about 2 wt.-% oligomers. The non-reacted LA (+GVL) as well as light reaction products (e.g. $CO_2$) and water were separated by distillation.

The distillation product containing the LA dimers and oligomers was subjected to preliminary hydrogenation/HDO with a Pd/C catalyst at 235° C., WHSV 1/h, using 50 bars reactor pressure and with $H_2$/Oil ratio 700 NL $H_2$/l oil. The conversion product was then fully hydrodeoxygenated at 310° C., 80 bars, WHSV 0.5 and $H_2$/oil ratio 2200.

The hydrogenated product has been distilled to final boiling point of 180° C.

The distilled HDO product (DVPE adjustment material) was blended with of ethanol and conventional fossil fuel (oxygen-free fossil based gasoline) so as to give a light fuel (designated as E1D5) having an ethanol content of 1 vol % and a content of the DVPE adjustment material of 5 vol %.

The results of DVPE measurement (according to EN 13016-1) are shown in Table 1.

Further, the results of hydrocarbon analysis of the DVPE adjustment material are shown in Table 2.

Reference Example 1

For comparison, the DVPE of a fuel (designated as E0) consisting of the conventional fossil fuel used in Example 1 was measured. The results are shown in Table 1.

Reference Examples 2 to 4

For comparison, the DVPE of a fuel (designated as E1 , E3, E10) comprising of the conventional fossil fuel used in Example 1 and 1 vol %, 3 vol % and 10 vol % of ethanol, respectively, were measured. The results are shown in Table 1.

Examples 2 to 6

Light fuels obtained by blending the conventional fossil fuel used in Example 1, the DVPE adjustment material used in Example 1 and ethanol in varying amounts were produced. The compositions as well as the results of the DVPE measurement are shown in Table 1.

Example 7

A DVPE adjustment material was obtained using the same route in conversion as in Example 1. After that, the distillation product containing the LA dimers and oligomers was subjected to HDO in a tubular reactor at a hydrogen pressure of 80 bar, a temperature of 306° C., WHSV of 0.3 $h^{-1}$, a sulfided NiMo hydrogenation catalyst supported on alumina and a flow rate of hydrogen to conversion product of 2100 Nl/l.

The composition of the DVPE adjustment material was analyzed using GC/MS hydrocarbon analysis. The results are shown in Table 3.

TABLE 1

Composition and DVPE measurement results

| Example | Fuel designation | Ethanol content | content of DVPE adj. material | DVPE (kPa) | comp. factor x |
|---|---|---|---|---|---|
| Ref. Ex. 1 | E0 | 0 vol % | 0 vol % | 66.0 | — |
| Ref. Ex. 2 | E1 | 1 vol % | 0 vol % | 69.6 | — |
| Ex. 1 | E1D5 | 1 vol % | 5 vol % | 67.3 | 0.64 |
| Ex. 2 | E1D10 | 1 vol % | 10 vol % | 64.5 | 1.42 |
| Ref. Ex. 3 | E3 | 3 vol % | 0 vol % | 72.0 | — |
| Ex. 3 | E3D5 | 3 vol % | 5 vol % | 69.4 | 0.43 |
| Ex. 4 | E3D10 | 3 vol % | 10 vol % | 66.9 | 0.85 |
| Ref. Ex. 4 | E10 | 10 vol % | 0 vol % | 73.4 | — |
| Ex. 5 | E10D5 | 10 vol % | 5 vol % | 70.7 | 0.36 |
| Ex. 6 | E10D10 | 10 vol % | 10 vol % | 68.2 | 0.70 |

Figure 2:
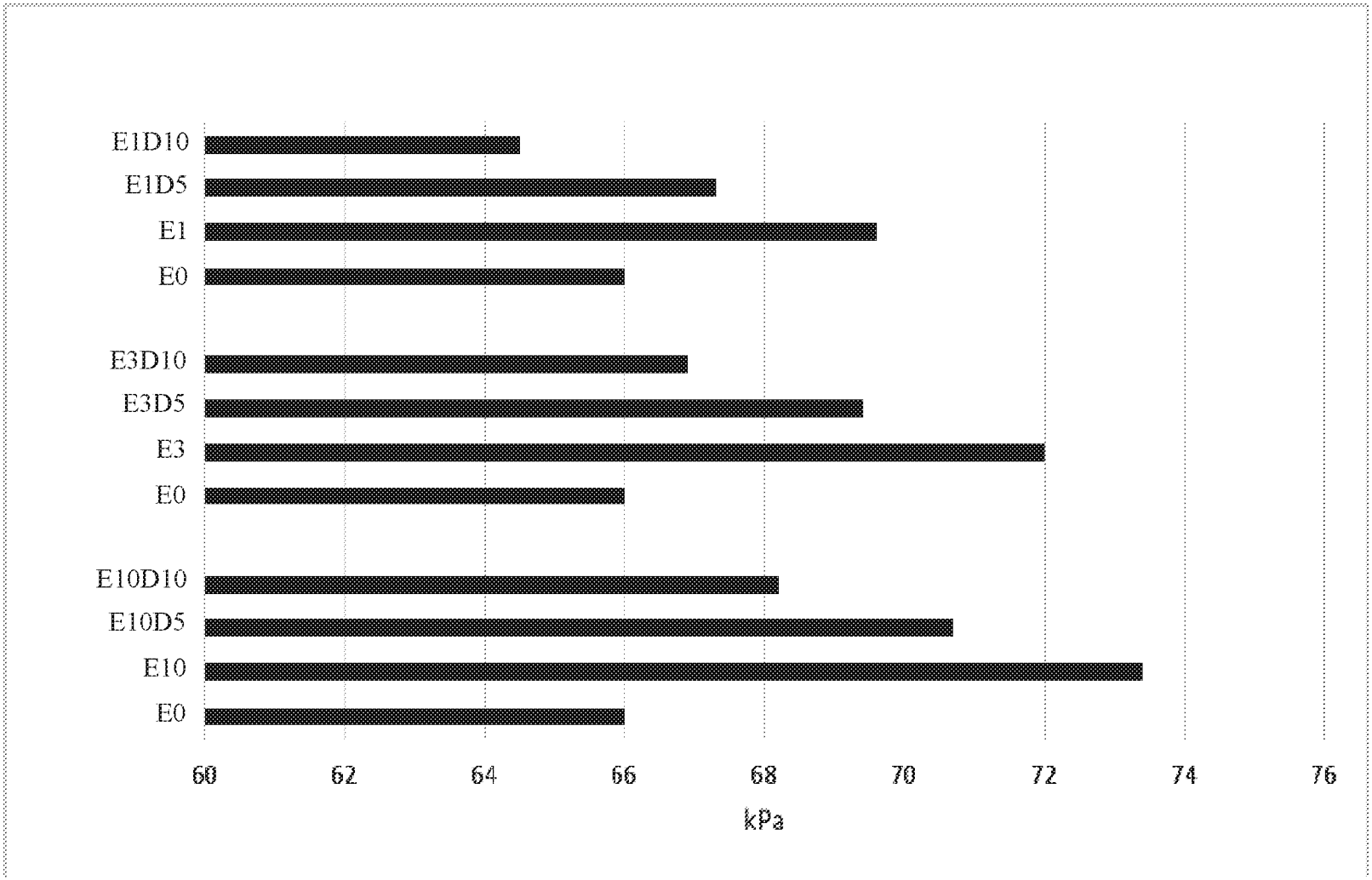
FIG. 2 is a diagram showing the DVPE reduction effects achieved in fuel blends containing the DVPE adjustment material of the present invention.

The results of Table 1 are further illustrated in FIG. 2. As can be seen, the ethanol induced DVPE increase can be significantly reduced by including 5 vol % of the DVPE adjustment material for both 1 vol % and 3 vol % of ethanol and can be compensated by adding 10 vol %. In the case of a 10 vol % ethanol fuel, an addition of 15 vol % of the DVPE adjustment material can be expected to compensate the ethanol induced DVPE increase. Accordingly, it has been shown that the DVPE adjustment material can be suitably used for fine adjustment of the DVPE of fuel having an ethanol content in a broad range.

TABLE 2

Hydrocarbon analysis of DVPE adjustment material of Example 1

| | | Example 1 |
|---|---|---|
| COMPOSITION | | |
| Paraffins | wt-% | 46.2 |
| Olefins | wt-% | 0.0 |
| Oxygenates | wt-% | 0.1 |
| Dienes | wt-% | 0.0 |
| Naphthenes | wt-% | 52.5 |
| Aromatics | wt-% | 1.2 |
| DISTRIBUTION | | |
| C1-C7 | wt-% | 0.9 |
| C8 | wt-% | 5.3 |
| C9 | wt-% | 39.7 |
| C10 | wt-% | 53.8 |
| C11-C18 | wt-% | 0.4 |
| Unknown | wt-% | 0.0 |

TABLE 3

Analysis results of hydrocarbon compositions of Example 7

| | | Example 7 |
|---|---|---|
| COMPOSITION | | |
| Paraffins | wt-% | 32.2 |
| Olefins | wt-% | <0.1 |
| Oxygenates | wt-% | <0.1 |
| Dienes | wt-% | <0.1 |
| Naphthenes | wt-% | 66.2 |
| Aromatics | wt-% | 1.5 |
| DISTRIBUTION | | |
| C1-C7 | wt-% | 2.6 |
| C8 | wt-% | 8.9 |
| C9 | wt-% | 52.8 |
| C10 | wt-% | 35.0 |
| C11-C18 | wt-% | 0.7 |
| Unknown | wt-% | 0.1 |

The invention claimed is:

1. A light fuel composition comprising:

fossil fuel, ethanol, and a material for adjusting a dry vapour pressure equivalent (DVPE adjustment material), wherein the DVPE adjustment material is a bio-hydrocarbon composition, wherein the bio-hydrocarbon composition has a content of naphthenes of from 30% by weight to 80% by weight, wherein the bio-hydrocarbon composition has a content of paraffins of from 15% by weight to 70% by weight, wherein the majority of the paraffins in the bio-hydrocarbon composition contain 9 or 10 carbon atoms, wherein the content of the ethanol in the light fuel composition is 40.0% by volume or less, and wherein the majority of the bio-hydrocarbon composition contains 9 or 10 carbon atoms.

2. The light fuel according to claim 1, wherein: the DVPE adjustment material is contained in such an amount that the following formula (1) is fulfilled:

$$Dg \leq Df + (1-x)*(Dfe-Df) \quad (1)$$

wherein Dg is the DVPE of the light fuel, Dfe is the DVPE of a mixture (fe) of the fossil fuel and the ethanol, the mixture (fe) having an ethanol content (by volume) which is the same as that of the light fuel, and Df is the DVPE of the fossil fuel, wherein the DVPE is measured in accordance with EN 13016-1, and x is 0.30 or more.

3. The light fuel according to claim 1, wherein: the DVPE of the light fuel, as measured in accordance with EN 13016-1, is less than 90 kPa.

4. The light fuel according to claim 1, wherein: a content of the DVPE adjustment material is 0.1% by volume or more.

5. The light fuel according to claim 1, wherein:

a content of the ethanol in the light fuel is 0.1% by volume or more.

6. The light fuel according to claim 1, wherein:

a content of the ethanol in the light fuel is 0.1% by volume or more; and/or a content of the ethanol in the light fuel is 7.0% by volume or less.

7. The light fuel according to claim 1, wherein:

the bio-hydrocarbon composition has a content of aromatics of 35.0% by weight or less.

8. The light fuel according to claim 1, wherein: the bio-hydrocarbon composition an oxygen-containing bio-precursor composition subjected to a hydrodeoxygenation (HDO) treatment.

9. The light fuel according to claim 8, wherein:

the bio-precursor composition is a raw material from a renewable source subjected to at least one C—C-coupling reaction.

10. The light fuel according to claim 1, wherein:

the bio-hydrocarbon composition is derived from a raw material containing a ketoacid or a derivative thereof derived from a renewable source; and the ketoacid or the derivative thereof is levulinic acid or a derivative thereof.

11. The light fuel according to claim 1, wherein:

the fossil fuel is a fossil hydrocarbon fraction, in which 90% by weight of all hydrocarbons have a carbon number in the a range of 3 to 13.

12. A method for producing a light fuel, the method comprising:

blending a fossil fuel, ethanol and a material for adjusting a dry vapour pressure equivalent (DVPE adjustment material), wherein the DVPE adjustment material is a bio-hydrocarbon composition, wherein the bio-hydrocarbon composition has a content of naphthenes of from 30% by weight to 80% by weight, wherein the bio-hydrocarbon composition has a content of paraffins of from 15% by weight to 70% by weight, wherein the majority of the paraffins in the bio-hydrocarbon composition contain 9 or 10 carbon atoms, wherein the content of the ethanol in the light fuel composition is 40.0% by volume or less, and wherein the majority of the bio-hydrocarbon composition contains 9 or 10 carbon atoms.

13. The light fuel according to claim 1, wherein:

the DVPE adjustment material is contained in such an amount that the following formula (1) is fulfilled:

$$Dg \leq Df + (1-x)*(Dfe-Df) \quad (1)$$

wherein Dg is the DVPE of the light fuel, Dfe is the DVPE of a mixture (fe) of the fossil fuel and the ethanol, the mixture (fe) having an ethanol content (by volume) which is the same as that of the light fuel, and Df is the DVPE of the fossil fuel, wherein the DVPE is measured in accordance with EN 13016-1, and x is one of 0.35, 0.40, 0.50, 0.60, 0.70, 0.80, 0.90, or 1.0.

14. The light fuel according to claim 2, wherein: the DVPE of the light fuel, as measured in accordance with EN 13016-1, is less than 63.0 kPa.

15. The light fuel according to claim 2, wherein:

a content of the DVPE adjustment material is 3.0% by volume or more.

16. The light fuel according to claim 2, wherein: a content of the ethanol in the light fuel is 0.5% by volume or more; and/or a content of the ethanol in the light fuel is 11.0% by volume or less.

17. The light fuel according to claim 2, wherein: a content of the ethanol in the light fuel is 0.5% by volume or more; and/or a content of the ethanol in the light fuel is 3.0% by volume or less.

18. The light fuel according to claim 2, wherein: the bio-hydrocarbon composition has a content of naphthenes of 35% by weight or more; and/or the bio-hydrocarbon composition has a content of naphthenes of 66% by weight or less.

19. The light fuel according to claim 2, wherein: the bio-hydrocarbon composition has a content of paraffins of 20% by weight or more; and/or the bio-hydrocarbon composition has a content of paraffins of 46% by weight or less.

20. The light fuel according to claim 2, wherein: the bio-hydrocarbon composition has a content of aromatics of 1.6% by weight or less.

21. The light fuel according to claim 1, wherein:

the bio-hydrocarbon composition comprises hydrocarbons having a carbon number in the range of 5 to 12.

* * * * *